US008038110B2

(12) United States Patent
Talbott

(10) Patent No.: US 8,038,110 B2
(45) Date of Patent: Oct. 18, 2011

(54) ARTICLE HOLDING DEVICE FOR AERIAL WORK PLATFORM

(76) Inventor: William Karl Talbott, Elkins, WV (US)

( * ) Notice: Subject to any disclaimer, the term of this patent is extended or adjusted under 35 U.S.C. 154(b) by 213 days.

(21) Appl. No.: 12/563,509

(22) Filed: Sep. 21, 2009

(65) Prior Publication Data

US 2010/0108684 A1 May 6, 2010

Related U.S. Application Data

(60) Provisional application No. 61/100,035, filed on Sep. 25, 2008.

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |

(52) U.S. Cl. ..... 248/214; 248/309.1; 248/311.2; 248/351; 248/354.1; 211/184

(58) Field of Classification Search ..... 248/201, 248/214, 215, 309.1, 311.2, 351, 354.1; 182/69.5; 211/184, 183, 208, 207
See application file for complete search history.

(56) References Cited

U.S. PATENT DOCUMENTS

| | | | | | |
|---|---|---|---|---|---|
| D129,724 | S | * | 9/1941 | Gardner | D19/75 |
| 4,406,368 | A | * | 9/1983 | Hermes | 206/371 |
| D290,852 | S | * | 7/1987 | Wang | D19/75 |
| D316,565 | S | * | 4/1991 | Rust | D19/75 |
| 5,158,023 | A | * | 10/1992 | Allen | 108/42 |
| 5,683,063 | A | * | 11/1997 | Seiders et al. | 248/214 |
| 5,967,259 | A | * | 10/1999 | Williams | 182/129 |
| 6,095,057 | A | | 8/2000 | Corban | |
| 2005/0067361 | A1 | | 3/2005 | Waymine | |
| 2006/0021985 | A1 | | 2/2006 | Jasper | |
| 2007/0131632 | A1 | * | 6/2007 | Brown et al. | 211/126.13 |
| 2007/0187184 | A1 | * | 8/2007 | Nasuti et al. | 187/269 |

* cited by examiner

*Primary Examiner* — Amy J Sterling

(74) *Attorney, Agent, or Firm* — L.C. Begin & Associates, PLLC

(57) ABSTRACT

An article holding device, for an elevated work platform having a railing configured by a plurality of horizontal bars, includes a body member and at least one bracing member. The body member is adapted to be disposed on the railing and the at least one bracing member is capable of supporting the body member on the elevated work platform. The body member includes a first compartment, a second compartment and a channel unit disposed therebetween. The first compartment and the second compartment include a plurality of adjustable sections configured therein. The first compartment, the second compartment and the channel unit are capable of receiving articles therein. The at least one bracing member is capable of being adjustably positioned between at least two horizontal bars of the plurality of horizontal bars of the railing for supporting the body member on the elevated work platform.

12 Claims, 6 Drawing Sheets

ARTICLE HOLDING DEVICE FOR AERIAL WORK PLATFORM

CROSS-REFERENCE TO RELATED APPLICATIONS

The present disclosure claims priority under 35 United States Code, Section 119 on the U.S. Provisional Patent Application numbered 61/100,035 filed on Sep. 25, 2008 the disclosure of which is incorporated by reference.

FIELD OF THE DISCLOSURE

The present disclosure relates to articles holding equipment and more particularly, to an article holding device to be utilized with an aerial work platform for organizing articles.

BACKGROUND OF THE DISCLOSURE

Various articles, such as tools or any other objects are carried by workers for performing tasks from elevated work platforms. Handling such articles on the elevated work platforms is a cumbersome task for the workers. Generally, the workers may place the articles on decks of the elevated work platforms, and accordingly perform such tasks while standing on the work platforms. The articles placed on the decks may pose a problem as the articles may get scattered or laid out of the decks leading the workers to a risk of slipping, falling or dropping the articles on a person below the work platforms.

In light of the aforesaid problem, homemade open containers, tool bags are often used for storing the articles for performing the tasks from the elevated work platforms. Most of such homemade open containers and tool bags are ineffective and do not last long, and are often cumbersome to use while working from the elevated work platforms.

Accordingly, there exists a need to refrain articles from getting scattered or laid out of elevated work platforms in order to avoid workers a risk of slipping, falling or dropping the articles on a person below the elevated work platforms. Furthermore, there exists a need of an effective and long lasting device that may be conveniently used by the workers while working from the elevated work platforms.

SUMMARY OF THE DISCLOSURE

In view of the foregoing disadvantages inherent in the prior art, the general purpose of the present disclosure is to provide an article holding device for an aerial work platform, to include all advantages of the prior art, and to overcome the drawbacks inherent in the prior art.

An object of the present disclosure is to provide an article holding device capable of refraining articles from getting scattered or laid out of the elevated work platforms in order to avoid workers a risk of slipping, falling or dropping the articles on a person below the elevated work platforms.

An object of the present disclosure is to provide an article holding device that is effective and long lasting, and capable of being utilized conveniently by the workers while working, without wearing a tool-belt, from the elevated work platforms. Further, the article holding device may be securely screwed to a lift or an elevated work platform.

In light of the above objects, in an aspect of the present disclosure an article holding device for an elevated work platform is provided. The elevated work platform may include a railing configured by a plurality of horizontal bars arranged in a spaced apart relation to each other. The article holding device includes a body member, and at least one bracing member adapted to be configured with the body member. The body member is adapted to be disposed on the railing, and the at least one bracing member is capable of supporting the body member on the work platform. The body member includes at least a first compartment, at least a second compartment, disposed opposite to the first compartment, and a channel unit configured therebetween. At least one of the first compartments and at least one of the second compartments of the body member include a plurality of adjustable sections configured therein. The plurality of adjustable sections is configured by a plurality of vertical plates removably disposed in a spaced apart relation from each other in the at least one of the first compartments and at least one of the second compartments. Further, the channel unit is disposed between the first compartment and the second compartment. Each of the first compartment, the second compartment and the channel unit is capable of receiving articles therein. Furthermore, the at least one bracing member includes a first hollow elongated member, and a second elongated member adjustably disposed within the first hollow elongated member. The at least one bracing member is capable of being adjustably positioned between at least two horizontal bars of the plurality of horizontal bars for supporting the body member on the elevated work platform.

The article holding device, as disclosed, is capable of being removably attached to the railing of the elevated work platform, thereby enabling workers on the work platform to store the articles in each of the first compartment, the second compartment and the channel unit of the body member. Such storage of the articles in the article holding device refrains the articles from getting scattered or laid out of the work platform in order to avoid the workers a risk of slipping, falling or dropping the articles on a person below the work platform. Further, the at least one bracing member is capable of being adjustably positioned between the at least two horizontal bars of the plurality of horizontal bars for supporting the body member on the elevated work platform, thereby providing effective and long lasting article holding device. Furthermore, the article holding device disposed on the railing of the elevated work platform facilitates the workers to conveniently work from the work platform.

These together with the other aspects of the present disclosure, along with the various features of novelty that characterized the present disclosure, are pointed out with particularity in the claims annexed hereto and form a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

For a thorough understanding of the present disclosure, reference is to be made to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The term "first," "second," and the like, herein do not denote any order, elevation or importance, but rather are used to distinguish placement of one element over another. Further, the terms "a" and "an" herein do not denote a limitation of quantity, but rather denote the presence of at least one of the referenced item.

The term "elevated work platform" or "platform" used herein includes, but not limited to, lifts, scissor lifts or any other elevated surface. Further, the term "articles" used herein includes, but not limited to, tools or other materials that are required by workers, such as contractors, electricians or carpenters for performing tasks relating to construction, maintenance and the like, from an elevated work platform.

Figure 1:
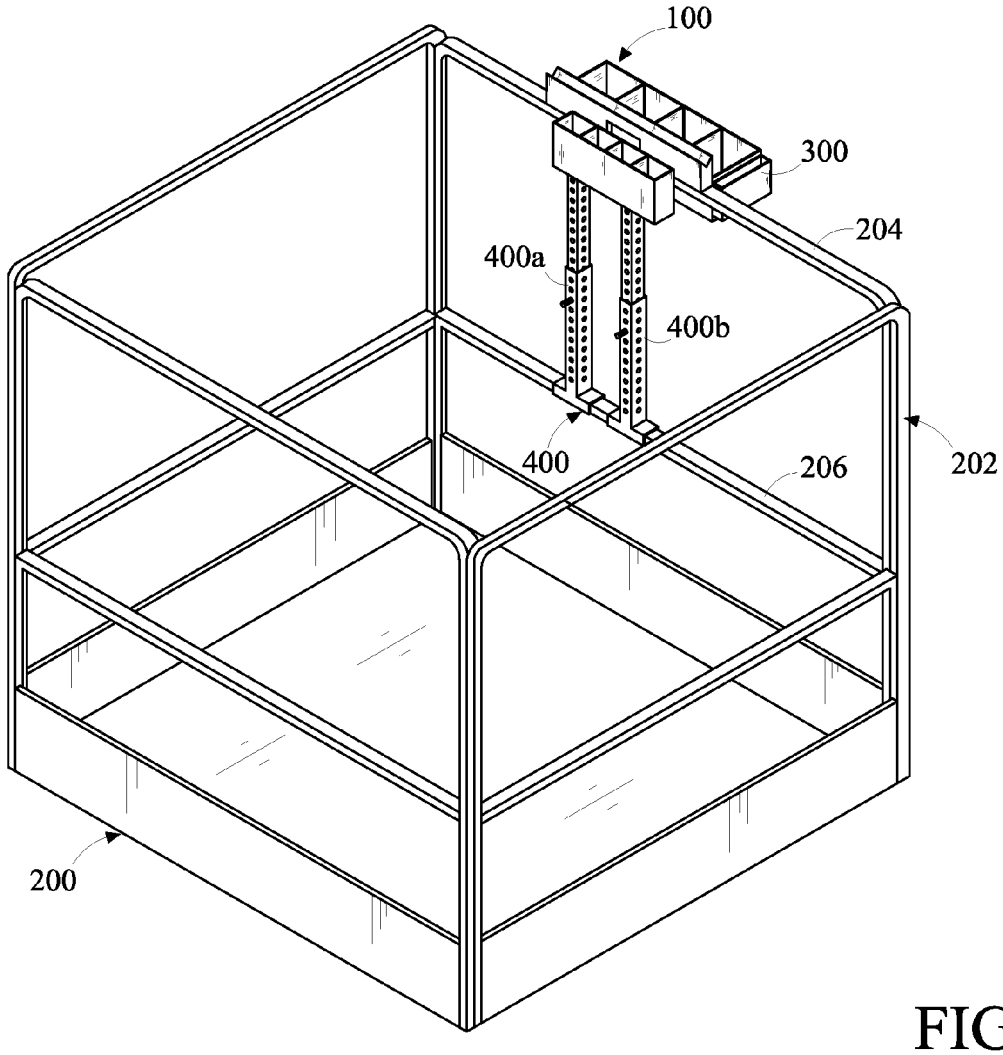
FIG. 1 illustrates a perspective view of an article holding device supported on an elevated work platform, in accordance with an exemplary embodiment of the present disclosure.
Figure 2:
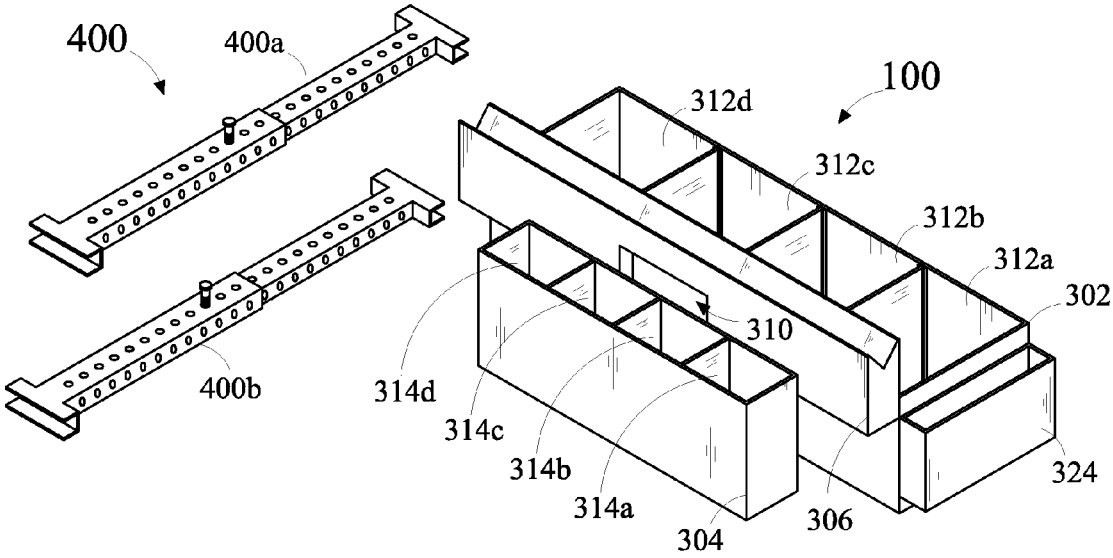
FIG. 2 illustrates a perspective view of an article holding device, in accordance with an exemplary embodiment of the present disclosure.

Referring now to FIGS. 1 and 2, an article holding device 100 (hereinafter referred to as 'device 100 ') is illustrated in accordance with an exemplary embodiment of the present disclosure. Specifically, FIG. 1 illustrates a perspective view of the device 100 supported on an elevated work platform 200 (hereinafter referred to as 'platform 200 '), and FIG. 2 illustrates a perspective view of the device 100.

As shown in FIG. 1, the device 100 is disposed on a railing 202 of the platform 200. The railing 202 is configured by a plurality of horizontal bars, such as a first horizontal bar 204 and a second horizontal bar 206, to which the device 100 is disposed. More particularly, the device 100 includes a body member 300 and at least one bracing member. In the present embodiment of the disclosure, the at least one bracing member is shown to include two bracing members 400*a* and 400*b* (hereinafter also collectively referred to as "bracing members 400"). However, it will be evident to a person skilled in the art to include one or more bracing members, such as the bracing members 400. According to one embodiment of the present disclosure, the body member 300 is adapted to be disposed on the first horizontal bar 204 of the railing 202. Further, the bracing members 400 may be disposed between at least two horizontal bars of the plurality of the horizontal bars, such as the first horizontal bar 204 and the second horizontal bar 206 for supporting the body member 300. As shown in FIG. 1, the bracing members 400*a* and 400*b* are disposed between the first horizontal bar 204 and the second horizontal bar 206 in a spaced apart manner from each other. However without departing from the scope of the present disclosure, only one bracing member, such as the bracing members 400*a* or 400*b*, may be disposed between the first horizontal bar 204 and the second horizontal bar 206 for supporting the body member 300. The body member 300 and the bracing members 400 will be described in conjunction with FIGS. 3A to 4B.

Figure 3A:
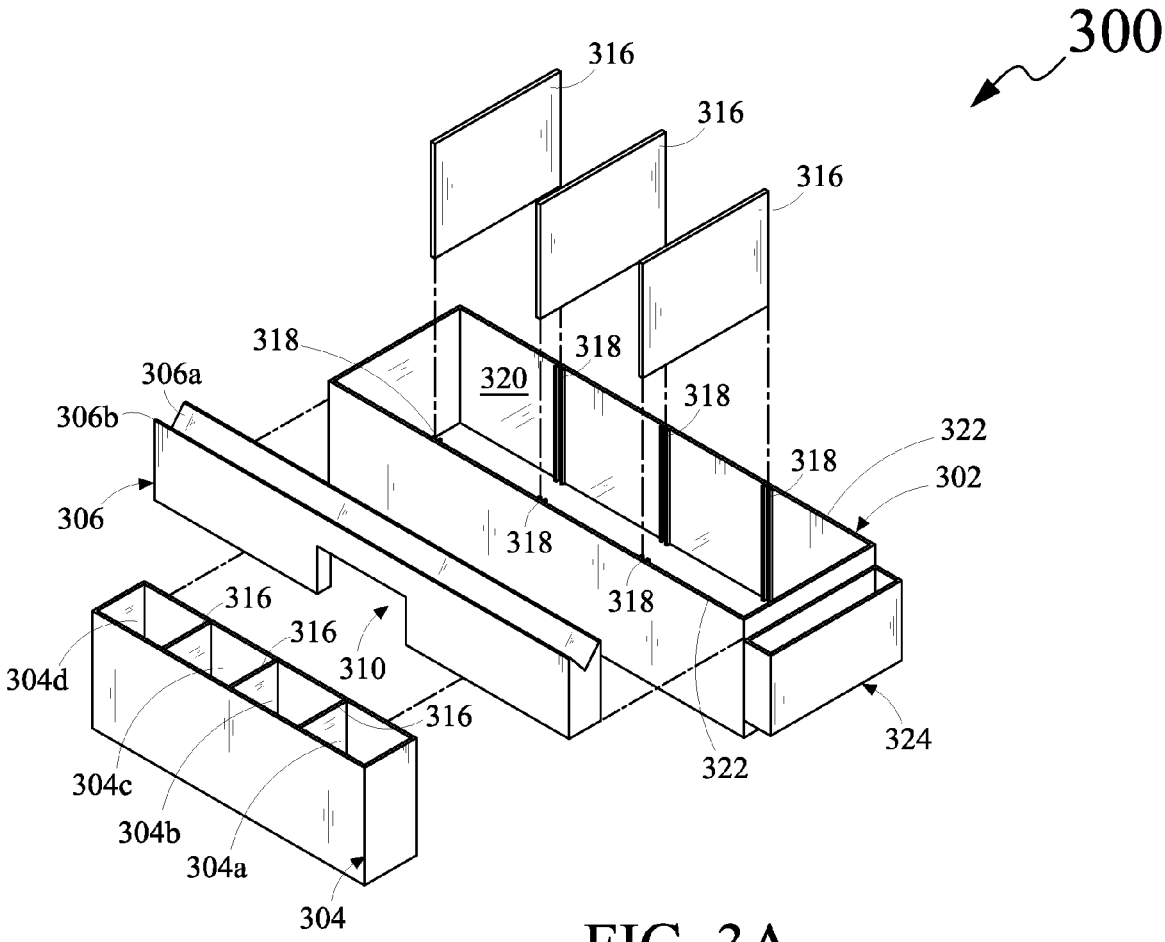
FIG. 3A illustrates an exploded perspective view of a body member of the article holding device of FIG. 2, in accordance with an exemplary embodiment of the present disclosure.
Figure 3B:
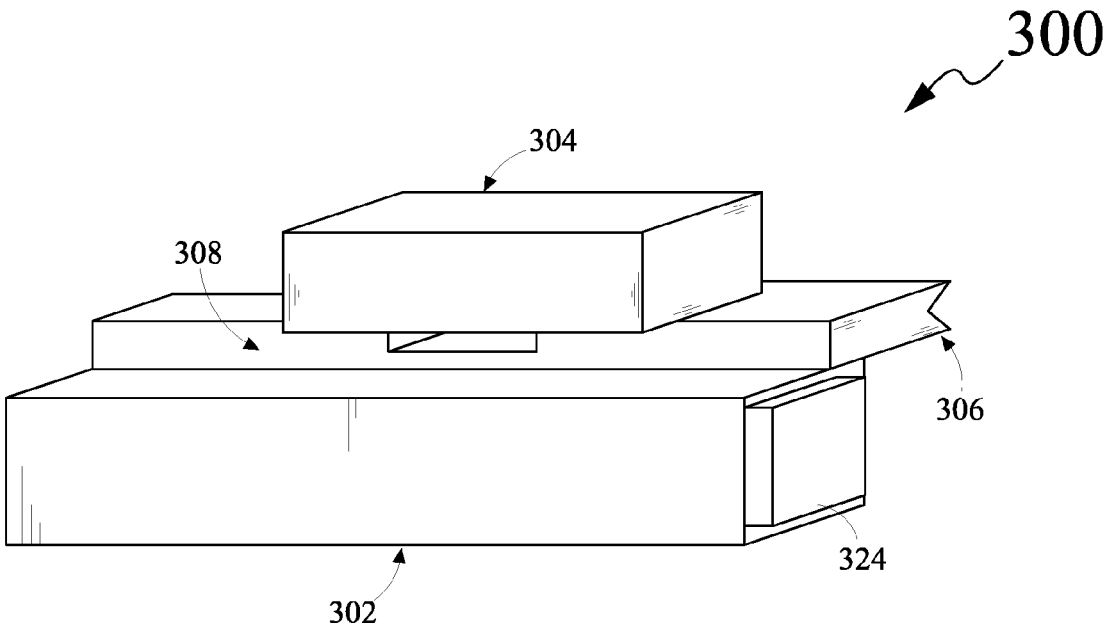
FIG. 3B illustrates a bottom view of the body member of the article holding device, in accordance with an exemplary embodiment of the present disclosure.

Referring now to FIGS. 3A and 3B, the body member 300 is illustrated, in accordance with an exemplary embodiment of the present disclosure. Specifically, FIG. 3A illustrates an exploded perspective view of the body member 300 of the device 100, and FIG. 3B illustrates a bottom view of the body member 300 of the device 100. Herein reference to FIGS. 1 and 2 will be made to describe the body member 300. The body member 300 includes a first compartment 302, a second compartment 304 and a channel unit 306. The second compartment 304 is positioned opposite to the first compartment 302, and the channel unit 306 is disposed between the first compartment 302 and the second compartment 304. Specifically, the channel unit 306 is partially disposed between the first compartment 302 and the second compartment 304 such that a passage 308 (as shown in FIG. 3B) is configured therebetween. The body member 300 is disposed on the railing 202 through the passage 308. According to one embodiment of the present disclosure, the first compartment 302 and the second compartment 304 are positioned opposite to each other in such a manner that the passage 308 formed therebetween is straight. The passage 308 is capable of easily receiving the first horizontal bar 204 of the railing 202, thereby enabling the body member 300 to be disposed on the railing 202 of the platform 200. However without departing from the scope of the present disclosure, the passage 308 may be of any other shape, such as a tapered shape, depending upon shapes and sizes of railings for enabling the body member 300 to be easily disposed on various kinds of elevated work platforms known in the art. Further for disposing the body member 300 on the railing 202 or carrying the body member 300 to various places, the body member 300 includes a grooved handle portion 310.

As shown in FIG. 3A, the grooved handle portion 310 is configured on the channel unit 306. Specifically, a side portion from the channel unit 306 is cut out to configure the grooved handle portion 310. Without departing from the scope of the present disclosure, the grooved handle portion 310 may be configured to any other portion of the body member 300. The grooved handle portion 310 facilitates workers to easily grip the body member 300 for transporting the body member 300 to various places. Further, the workers may easily dispose the body member 300 on the railing 202 by gripping the body member 300 by the grooved handle portion 310 of the channel unit 306.

Further, the channel unit 306 includes a narrow slit 306*a*. The narrow slit 306*a* is configured at an upper longitudinal edge 306*b* of the channel unit 306. The narrow slit 306*a* is capable of storing articles therein. More particularly, the narrow slit 306*a* is capable of storing the articles, such as writing implements, nails, pins, small clips, and the like. Similar to the channel unit 306, the first compartment 302 and the second compartment 304 are also utilized for storing various articles, as per requirement of the tasks.

The first compartment 302 and the second compartment 304 may include various sections configured therein for receiving the articles in a particular fashion. Further, the various sections configured within the first compartment 302 and the second compartment 304 may be adjustable for increasing or decreasing sizes thereof, if required. At least one of the first compartment 302 and the second compartment 304 may include a plurality of adjustable sections configured therein for receiving the articles in a particular fashion. According to one embodiment of the present disclosure, the first compartment 302 of the body member 300 includes the plurality of adjustable sections, such as adjustable sections 312*a*, 312*b*, 312*c* and 312*d* (hereinafter also referred to as "adjustable sections 312", see FIG. 2), and the second compartment 304 includes non-adjustable sections 314*a*, 314*b*, 314*c* and 314*d* (hereinafter also collectively referred to as "non-adjustable sections 314", see FIG. 2). In another embodiment of the present disclosure, both of the first compartment 302 and the second compartment 304 may include the plurality of adjustable sections, such as the adjustable sections 312. Moreover in further embodiment of the present disclosure, both of the first compartment 302 and the second compartment 304 may include non-adjustable sections, such as the non-adjustable sections 314, if required. Numbers of the adjustable sections 312 and the non-adjustable sections 314 may vary as per the workers' preferences, and the numbers of the adjustable sections 312 and the non-adjustable sections 314 as shown in any of the figures or described herein may not be considered to be limiting.

The adjustable sections 312 of the first compartment 302 are configure by a plurality of vertical plates, such as plates 316, removably disposed in a spaced apart relation from each other in the first compartment 302. The first compartment includes a plurality of grooves, such as grooves 318 configured in a spaced apart relation from each other on inner surfaces 320 of opposite longitudinal sidewalls 322 of the first compartment 302. Each of the grooves 318 is capable of removably receiving a respective plate of the plates 316 for configuring the adjustable sections 312 in the first compartment 302. Further when required, the plates 316 may be removed from the respective grooves 318 for increasing a size of the adjustable sections 312. Similar to the first compartment 302, the second compartment 304 may include adjustable sections, such as the adjustable sections 314. However in the present embodiment, the second compartment 304 includes the non-adjustable sections 314. The non-adjustable sections 314 in the second compartment 304 are configured by the plates 316 fixedly disposed in a spaced apart relation from each other in the second compartment 304.

Further, the plates 316 that are removed from the first compartment 302 for increasing the sizes of the adjustable sections 312 are required to be stored at a particular location so that the plates 316 may not get misplaced. In order to attain the storage problem of the plates 316, an auxiliary compartment 324 is provided. The auxiliary compartment 324 is attached to the at least one of the first compartment 302 and the second compartment 304. According to one embodiment of the present disclosure, the auxiliary compartment 324 is attached to the first compartment 302. Specifically, the auxiliary compartment 324 may be attached to one of an outer sidewall of the first compartment 302. However, without departing from the scope of the present disclosure, the auxiliary compartment 324 may be attached to the second compartment 304 or to both. The auxiliary compartment 324 may receive the plates 316, upon the plates 316 being removed from the first compartment 302. Alternatively, the auxiliary compartment 324 may also store the articles, if not utilized for storing the plates 316 therein.

The first compartment 302 and the second compartment 304 are capable of receiving the articles as per requirement of the workers for performing the tasks from the platform 200. For example, the first compartment 302 and the second compartment 304 are capable of receiving the articles, such as chisels, hammers, mallets, screw drivers, measuring devices, small construction and carpentry devices, and the like. Further, for storing the articles of substantially larger size, the size of the adjustable sections 312 of the first compartment 302 may be increased, as described above. Further, according to one embodiment of the present disclosure, the first compartment 302 and the second compartment 304 may be detached from each other so that to configure a body member, such as the body member 300, having any one of the first compartment 302 or the second compartment 304. Such body member may also be utilized by the workers those who are willing to carry only a few articles for performing a particular tasks from the platform 200. As shown in FIG. 1, when the body member 300 is disposed on the first horizontal bar 204 of the railing 202, the bracing members 400 may be placed between the first horizontal bar 204 and the second horizontal bar 206 of the railing 202 for supporting the body member 300 on the railing 202. The bracing members 400 will be described in conjunction with FIGS. 4A and 4B.

Figure 4A:
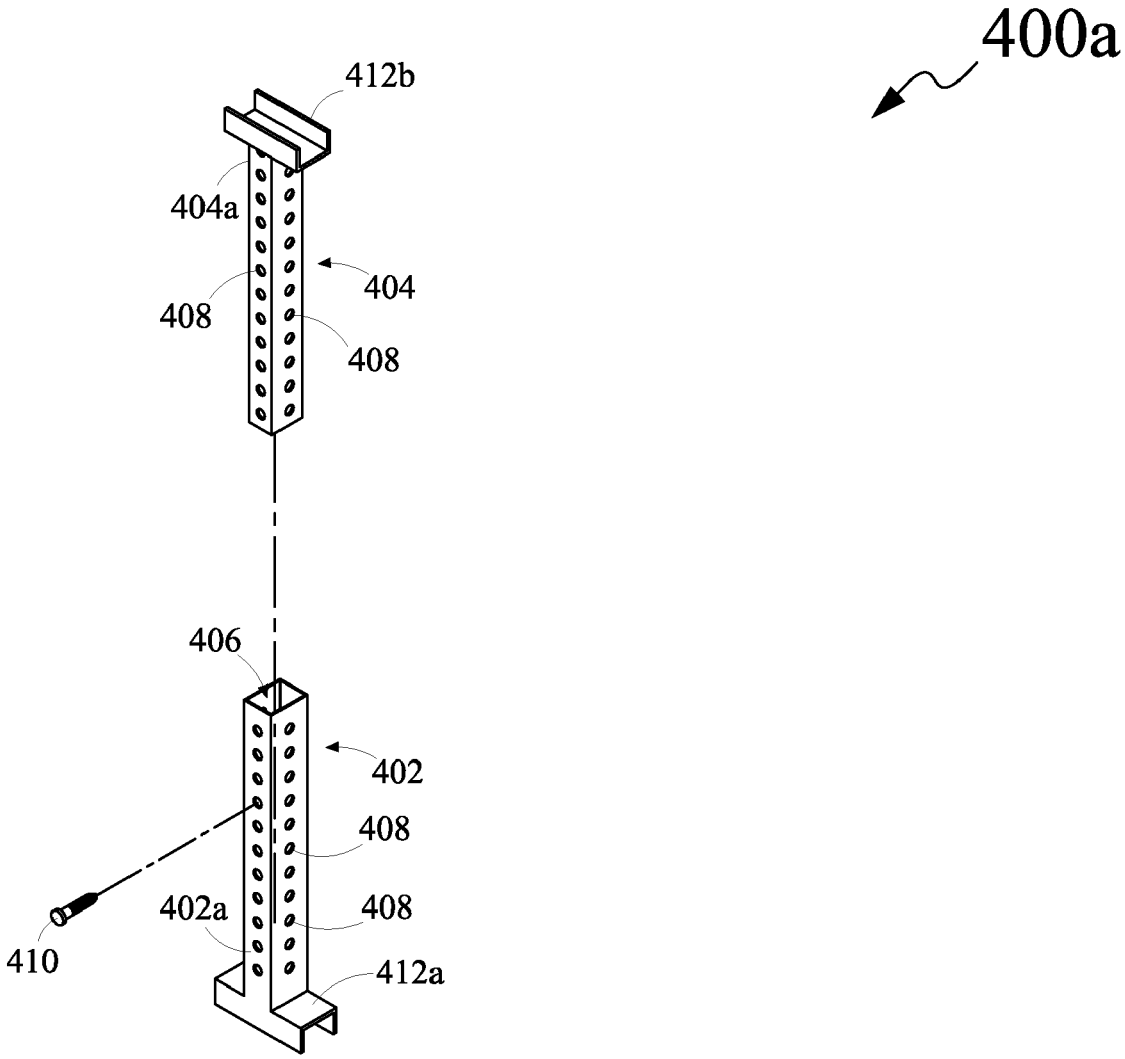
FIG. 4A illustrates an exploded perspective view of at least one bracing member of the article holding device of FIG. 2, in accordance with an exemplary embodiment of the present disclosure.
Figure 4B:
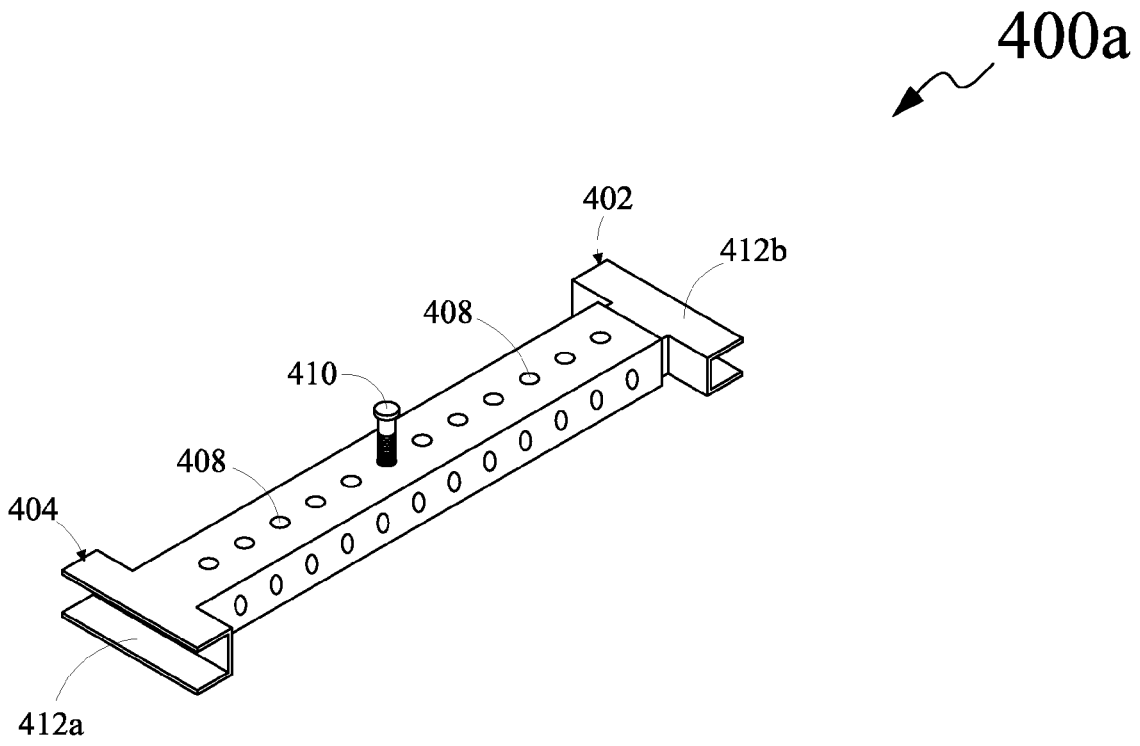
FIG. 4B illustrates an assembled perspective view of the at least one bracing member of the article holding device, in accordance with an exemplary embodiment of the present disclosure.

Referring now to FIGS. 4A and 4B, the bracing members 400 are illustrated in accordance with an exemplary embodiment of the present disclosure. Specifically, FIG. 4A illustrates an exploded perspective view of the at least one bracing member of the bracing members 400 of the device 100, and FIG. 4B illustrates an assembled perspective view of the at least one bracing member of the bracing members 400. Herein reference to FIGS. 1 and 2 will be made to describe the bracing members 400.

Each of the bracing members 400 includes a first hollow elongated member and a second elongated member adjustably disposed within the hollow elongated member. Herein in FIGS. 4A and 4B for the purpose of description, only one bracing member, such as the bracing member 400*a* is shown. However, it will be evident to a person skilled in the art that the bracing member 400*b* will include similar constructional features as the bracing member 400*a*. As shown in FIGS. 4A and 4B, the bracing member 400*a* includes a first hollow elongated member 402 and a second elongated member 404. The first hollow elongated member 402 includes an elongated cavity 406 configured along a length thereof for adjustably receiving the second elongated member 404 therein. Specifically, the second elongated member 404 is slidably receivable within the elongated cavity 406 of the first hollow elongated member 402 for configuring the bracing member 400*a* of variable lengths in order to be adjustably adapted between the first horizontal bar 204 and the second horizontal bar 206 of variable distance for supporting the body member 300 on the railing 202.

For configuring the bracing member 400*a* of variable lengths, each of the first hollow elongated member 402 and the second elongated member 404 includes a plurality of holes, such as through-and-through holes 408, configured in a spaced apart relation to each other on the each of the first hollow elongated member 402 and the second elongated member 404. Furthermore, each of the bracing members 400 includes a hook. As shown in FIGS. 4A and 4B, the bracing member 400*a* includes a hook 410. The hook 410 and the through-and-through holes 408 are capable of configuring the bracing member 400*a* of variable lengths so that the bracing member 400*a* may adjustably adapt the variable distance between the first horizontal bar 204 and the second horizontal bar 206 of the railing 202. Specifically, the hook 410 is capable of being received in one of the aligned through-and-through holes 408 of the second elongated member 404 and one of the through-and-through holes of the first hollow elongated member 402 to lock the first hollow elongated member 402 and the second elongated member 404 at a position. Once the elongated members 402 and 404 of the bracing member 400*a* are in place, they are secured in a locked position by the hook 410. At such locked position, the bracing member 400*a* is capable of supporting the body member 300 on the platform 200, when the bracing member 400*a* is placed between the first horizontal bar 204 and the second horizontal bar 206. Further, the hook 410 may be a J-shaped hook for hanging additional articles thereon. Additionally, a user may employ the through-and through holes 408 to fasten additional utility J-hooks on each brace for configuring supports for pipe racks. Further, a user may employ the through-and through holes 408 to fasten cup brackets at different levels at the inner and side faces of braces between horizontal bars 204 and 206. Such cup brackets on braces at opposing railings 202 are capable of carrying supporting member, such as pipes, which in turn supports and carries wire racks. Moreover, each of the bracing members 400 includes a pair of brackets. As shown in FIGS. 4A and 4B, the bracing member 400*a* includes a pair of brackets, such as a first bracket 412*a* and a second bracket 412*b*, configured to opposite ends of the bracing member 400*a*.

More specifically, the first bracket 412*a* is coupled to an end portion 402*a* of the first hollow elongated member 402, and the second bracket 412*b* is coupled to an end portion 404*a* of the second elongated member 404. The first bracket 412*a* and the second bracket 412*b* enable the bracing member 400*a* to be adjustably placed between the first horizontal bar 204 and the second horizontal bar 206. The first bracket 412*a* and the second bracket 412*b* accommodate the first horizontal bar 204 and the second horizontal bar 206 therein, respectively, to prevent the bracing member 400*a* from being expelled from between the first horizontal bar 204 and the second horizontal bar 206, and providing the body member 300 a rigid support on the railing 202.

According to one embodiment of the present disclosure as shown in FIG. 1, two bracing members, such as the bracing members 400*a* and 400*b* are disposed between the first horizontal bar 204 and the second horizontal bar 206 for supporting the body member 300 on the railing 202. However, it will be evident to a person skilled in the art to dispose only one such bracing member or more bracing members for supporting the body member 300 on the railing 202. Quantity and dimensions of such bracing member also depend upon dimensions of the body member 300. The dimensions of the body member 300 may vary as per the workers preferences. Depending upon the dimensions of the body member 300 dimensions of the bracing members 400 may also vary. It will be evident to a person skilled in the art to configure the body member 300 and the bracing members 400 of the device 100 of any suitable dimension. Moreover, the body member 300 and the bracing members 400 of the device 100 may be composed of any suitable material. According to one embodiment of the present disclosure, the body member 300 of the device 100 may be composed of a plastic material. The bracing members 400 of the device 100 may be composed of a metal material. The plastic material may be hard and durable to withstand various working conditions.

The present disclosure provides following advantages in light of an article holding device, such as the device 100. The article holding device is capable of being removably attached to railings of elevated work platforms to store articles. Such storage of the articles in the article holding device refrains the articles from getting scattered or laid out of the work platforms in order to avoid the workers a risk of slipping, falling or dropping the articles on a person below the work platforms. Furthermore, the article holding device disposed on the railings of the work platforms facilitates the workers to conveniently work from the elevated work platforms. The article holding device is ideal for the workers in all trades of construction and maintenance, including contractors, electricians or carpenters. Further, the article holding device may easily attach to any construction or maintenance vehicles to enhance the workers' safety by providing more space to move on and around the work platforms of any of the construction or maintenance vehicles.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An article holding device for an elevated work platform having a railing configured by a plurality of horizontal bars arranged in a spaced apart relation to each other, the article holding device comprising:

a body member adapted to be disposed on the railing, the body member comprising;

a first compartment and a second compartment opposite to the first compartment, the first compartment and the second compartment comprising a plurality of adjustable sections configured therein, wherein the plurality of adjustable sections is configured by a plurality of plates removably disposed in a spaced apart relation from each other in the first compartment and the second compartment;

a channel unit disposed between the first compartment and the second compartment, wherein each of the first compartment, the second compartment and the channel unit is capable of receiving articles therein; and at least one bracing member adapted to be configured with the body member, the at least one bracing member comprising a first hollow elongated member and a second elongated member adjustably disposed within the first hollow elongated member, wherein the at least one bracing member is capable of being adjustably positioned between at least two horizontal bars of the plurality of horizontal bars of the railing of the elevated work platform for supporting the body member on the elevated work platform.

2. The article holding device of claim 1 further comprising an auxiliary compartment attached to the first compartment and the second compartment, wherein the auxiliary compartment is capable of receiving the plurality of plates therein upon the plurality of plates being removed from the first compartment and the second compartment of the article holding device for increasing a size of the plurality of adjustable sections of the first compartment and the second compartment.

3. The article holding device of claim 1, wherein the first compartment and the second compartment comprises a plurality of grooves configured in a spaced apart relation from each other on inner surfaces of opposite sidewalls of the first compartment and the second compartment, each of the plurality of grooves capable of removably receiving a respective plate of the plurality of plates for configuring the plurality of adjustable sections in the first compartment and the second compartment.

4. The article holding device of claim 1, wherein the channel unit is partially disposed between the first compartment and the second compartment such that a passage is configured therebetween, wherein the body member is disposed on the railing through the passage.

5. The article holding device of claim 1, wherein the body member further comprises a grooved handle portion configured on the channel unit, the grooved handle portion enables carrying of the body member.

6. The article holding device of claim 1, wherein the at least one bracing member comprises a pair of brackets coupled to opposite ends of the at least one bracing member, the pair of brackets enables the at least one bracing member to be adjustably positioned between the at least two horizontal bars of the plurality of horizontal bars of the railing for supporting the body member on the elevated work platform.

7. The article holding device of claim 6, wherein each of the first hollow elongated member and the second elongated member of the at least one bracing member comprises a plurality of through-and-through holes configured thereon in a spaced apart relation to each other.

8. The article holding device of claim 7, wherein the at least one bracing member further comprises a hook, the hook capable of being received in the aligned holes of one of the holes of the plurality of through-and-through holes of the second elongated member and one of the holes of the plurality of through-and-through holes of the first hollow elongated member to lock the first hollow elongated member and the second elongated member at a position for adjustably disposing the at least one bracing member between the at least two horizontal bars of the plurality of horizontal bars of the railing to support the body member on the elevated work platform.

9. The article holding device of claim 1, wherein the at least one bracing member includes at least one utility hook disposed thereon for supporting tools and supplies.

10. The article holding device of claim 1, wherein the at least one bracing member includes at least one cup bracket attached thereon for receiving each end of a support member that carries a wire rack.

11. The article holding device of claim 1, wherein the body member is composed of a plastic material.

12. The article holding device of claim 1, wherein the at least one bracing member is composed of a metal material.

* * * * *